US006109417A

United States Patent [19]

Kovens et al.

[11] Patent Number: 6,109,417

[45] Date of Patent: Aug. 29, 2000

[54] ANTI-CORRUPTION COIN/TOKEN INPUT CHUTE

[75] Inventors: Steven A. Kovens, Owings Mills; Brian S. Kovens, Reisterstown; Ronald P. Brown, Cockeysville, all of Md.; Ronald F. Deuel, Shrewsbury, Pa.

[73] Assignee: Parkway Machine Corporation, Timonium, Md.

[21] Appl. No.: 09/185,028

[22] Filed: Nov. 3, 1998

[51] Int. Cl.[7] ..... G07F 1/04

[52] U.S. Cl. ..... 194/345; 194/348

[58] Field of Search ..... 194/321, 323, 194/345, 347, 348, 349

[56] References Cited

U.S. PATENT DOCUMENTS

| | | | |
|---|---|---|---|
| 2,326,214 | 8/1943 | Gottfried | 194/345 X |
| 3,929,257 | 12/1975 | Mohan . | |
| 4,062,435 | 12/1977 | Chalabian . | |
| 4,230,213 | 10/1980 | Spring . | |
| 4,306,644 | 12/1981 | Rockola et al. . | |
| 4,346,798 | 8/1982 | Agey, III . | |
| 4,911,280 | 3/1990 | Bruner . | |
| 5,027,937 | 7/1991 | Parish et al. | 194/348 |
| 5,156,250 | 10/1992 | Parish et al. . | |
| 5,226,520 | 7/1993 | Parker . | |
| 5,299,673 | 4/1994 | Wu . | |
| 5,303,808 | 4/1994 | Hiortdahl . | |
| 5,524,744 | 6/1996 | Wohlrab . | |
| 5,647,470 | 7/1997 | Bruner et al. . | |
| 5,706,927 | 1/1998 | Okitani et al. . | |

*Primary Examiner*—F. J. Bartuska
*Attorney, Agent, or Firm*—Cahn & Samuels, LLP

[57] ABSTRACT

An anti-corruption coin/token chute assembly is provided for use with conventional coin acceptance assemblies. The assembly includes a coin race having first and second side walls and a floor. The floor is provided with a plurality of apertures to facilitate release of foreign substances. An ejection member is movably coupled the coin race. The ejection member includes a coin race insert that, in the rest position, is nested in the coin race. The coin race insert also includes first and second side walls and a floor. The floor of the coin race insert is provided with a plurality of apertures and is advantageously positioned so that the apertures are in substantial alignment with the apertures of the floor of the coin race. Accordingly, unauthorized foreign substances, such as liquids, that are injected into the chute assembly are drained through the apertures before fouling the electronics of the coin acceptance assemblies.

19 Claims, 6 Drawing Sheets

ANTI-CORRUPTION COIN/TOKEN INPUT CHUTE

FIELD OF THE INVENTION

This invention relates generally to currency acceptance mechanisms, and more specifically, to a coin/token chute for minimizing adverse effects due to corruption of such acceptance mechanisms.

BACKGROUND OF THE INVENTION

As is well known, coin acceptance and collection systems are utilized in a wide variety of applications, including vending machines, telephones, etc. In a typical system, counting of coins or tokens is accomplished by passing the coins over a switch or other circuit control means located along the path of the falling coins. Actuation of the circuit control or switch means generates a credit in the amount of the traversing coin. When sufficient credit is accumulated, the vending cycle may be initiated to bring about delivery of selected commodities to the customer.

A significant problem with vending machines is theft. One of the more popular and insidious techniques that has evolved with the transition from purely mechanical to electromechanical vending machines involves the pouring or squirting of liquids, such as salt water, into the coin chute. This technique is known as "salting" and it is frequently implemented using a plastic squeeze bottle having a long spout such as familiar plastic mustard and ketchup dispensers or water bottles employed by cyclists. In other instances, a thin plastic tube attached to the squeeze bottle which is then inserted into the coin slot to circumvent any barriers or other protective devices.

When liquid is squirted into the coin chute of a typical vending machine, the liquid flows by gravity along the descending coin chute and sprays over the coin receiving, counting and credit mechanisms thereby shorting their related circuits and generally damaging the apparatus. On occasion, if the thief is lucky, such shorting may cause a machine to "jack pot", i.e., vend one or more times or even until all merchandise is vended. In still other instances the shorted circuits may cause money to be dispensed through the change or coin return mechanism, depending on the nature of the coin receiving mechanism.

Another significant problem with vending machines is vandalism. A popular form of vandalism includes packing or stuffing the coin chute with a blocking element such as a wad of paper, a slug, a straw, etc. In many instances, this type of vandalism can completely disable the vending machine without the operators knowledge thereby decreasing revenue of the operator.

Accordingly, there is a need for a coin/token chute that averts jamming and that diverts corruptive liquid from coin/token acceptance mechanisms.

SUMMARY OF THE INVENTION

The present invention overcomes the problems described above associated with known devices.

It is an object of the invention to provide a compact, efficient coin/token chute that is readily adaptable to known coin acceptance mechanisms.

It is another object of the invention to provide a substantially maintenance free coin/token chute.

It is yet another object of the invention to provide a device that guards against damage of coin acceptance mechanisms due to improper exposure to liquids.

It is a further object of the invention to provide a coin/token chute that employs a simple, effective anti-jamming mechanism.

The invention relates to an anti-corruption coin/token input chute assembly. In accordance with one aspect of the invention, a coin race is provided having first and second side walls and a floor. The floor includes a plurality of apertures that facilitate release of foreign substances. An ejection member is movably coupled to the first side wall. The ejection member includes a coin race insert sized to fit between the first and second side walls of the coin race. The coin race insert includes first and second side walls and a floor. The floor is provided with a plurality of apertures. The ejection member further includes a displacement arm that extends from the second side wall of the ejection member to move the ejection member from a first position to a second position. In the first position, the floor of the coin race and the floor of the coin race insert are substantially parallel and the apertures of the floor of the coin race are substantially aligned with the apertures of the floor of the coin race insert. In the second position, the floor of the coin race insert is displaced relative to the floor of the coin race to eject objects from the coin race.

In accordance with a second aspect of the invention, a coin race is provided having first and second side walls and a floor. The floor includes means for draining liquid for the coin race. Disposed within an movably coupled to the coin race is a means for ejecting objects from the coin race. This means further includes means for draining liquid arranged in substantial alignment with the means for draining liquid from the coin race.

Given the following enabling description of the drawings, the inventive anti-corruption coin/token chute assembly and the scope of the invention should become evident to a person of ordinary skill in the art.

DETAILED DESCRIPTION OF THE INVENTION

Figure 1:
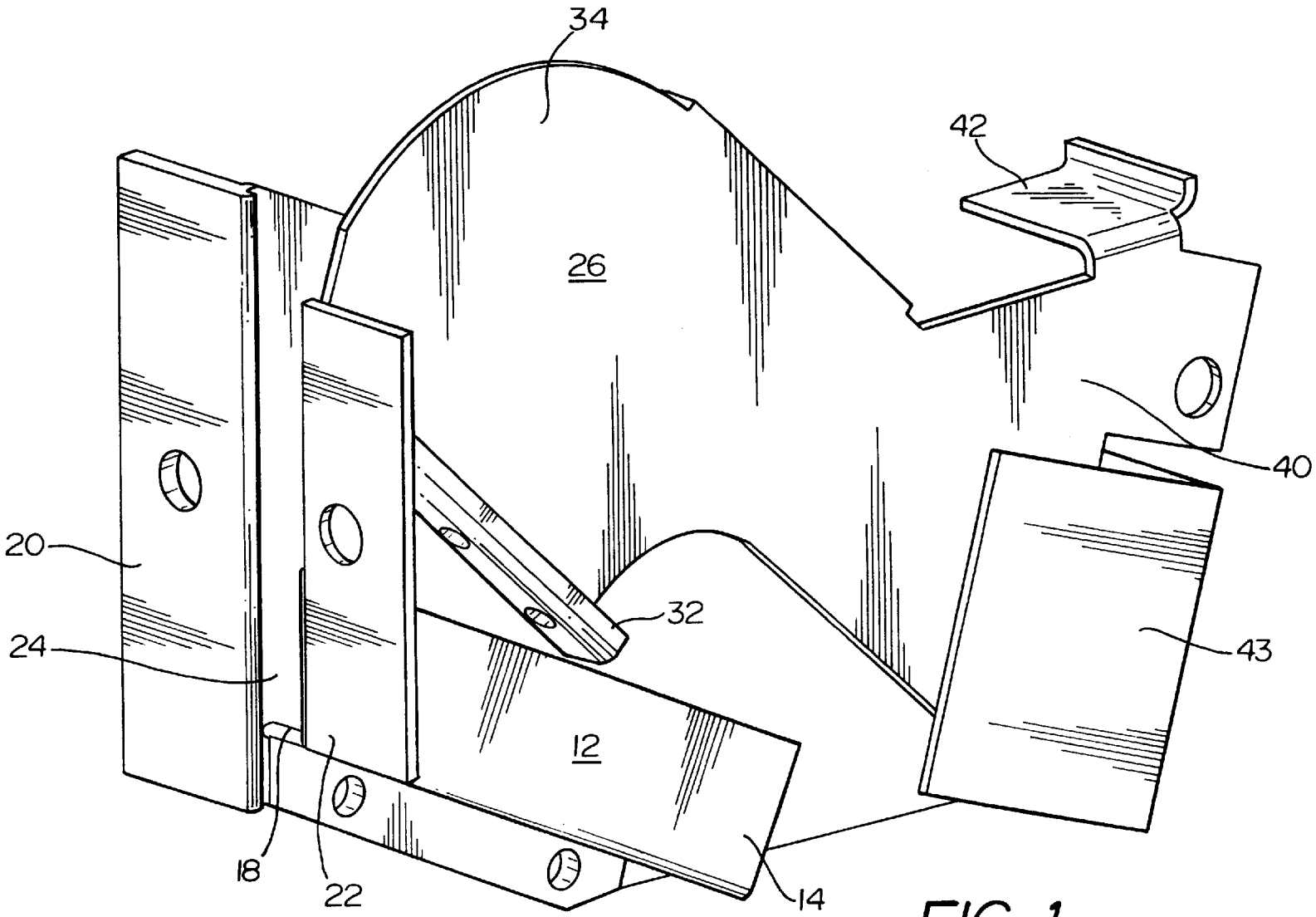
FIG. 1 is a front right perspective view of an anti-corruption coin/token chute assembly in accordance with the present invention.

With reference to the FIG. 1, an anti corruption coin/token input chute in accordance with the invention is generally depicted. In preferred applications, the anti-corruption coin/token input chute may be cooperatively engaged with any known coin acceptance assembly to form a coin collection system. Typical coin acceptance assemblies include standard coin changers such as the coin changers available from Coinco.

Figure 2:
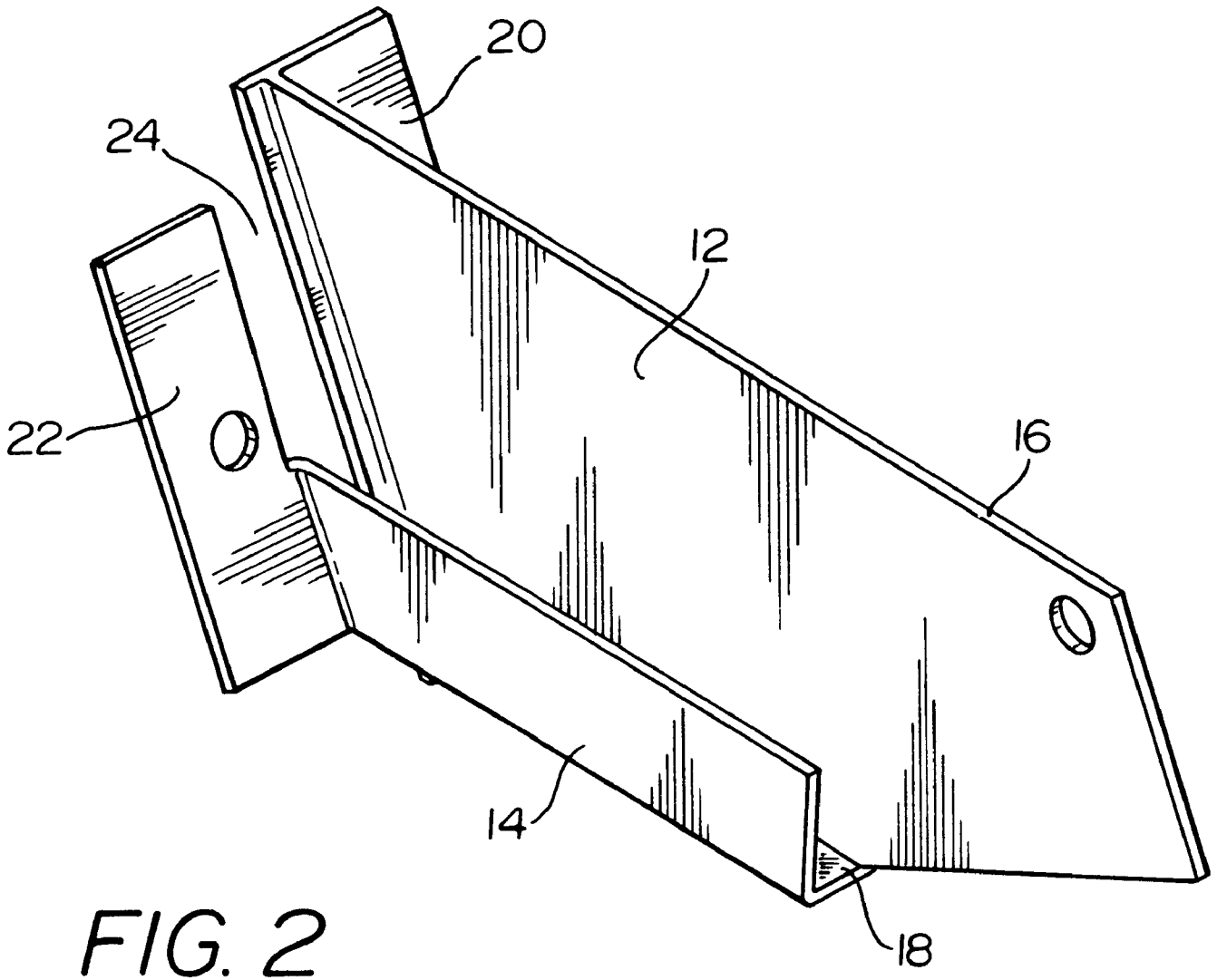
FIG. 2 is a perspective view of a coin race employed in the anti-corruption coin/token chute assembly depicted in FIG. 1.

In keeping with the invention, with reference to FIGS. 1 and 2, a coin race 12 directs coins to the coin acceptance assembly. Coin race 12 includes a first side wall 14 and a second side wall 16 that define lateral boundaries. Coin race 12 also includes a floor 18 that interconnects the first and second side walls 14, 16 such that the first and second side walls 14, 16 are separated by a distance defined by a width of the floor 18. This distance is referred to herein as the separation distance. Preferably, the separation distance is sufficient to accommodate standard coinage. Of course, the exact dimensions and configuration of coin race 12 may be selected in relation to the particular coins or tokens intended to be received within the anti-corruption coin/token input chute assembly 10.

Figure 6:
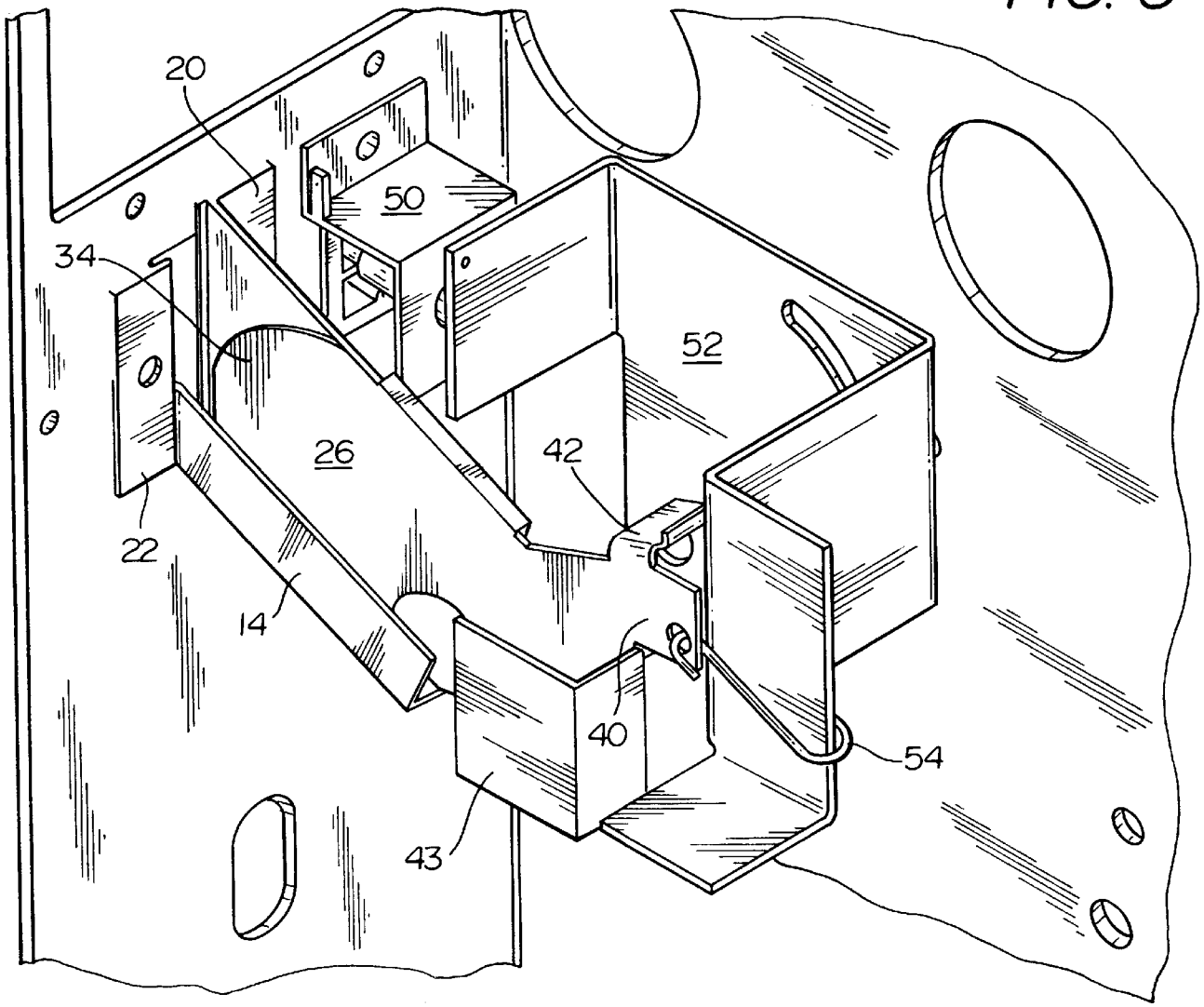
FIG. 6 depicts the anti-corruption coin/token chute assembly of the present invention in combination with a coin return assembly.

Coin race 12 is further provided with attachment plates 20 and 22. In a preferred embodiment, first and second attachment plates 20 and 22 are integrally formed with first and second side walls 14 and 16. The first and second attachment plates 20 and 22 and the first and second side walls 14, 16 cooperatively define a coin entrance 24. As illustrated in FIG. 6, attachment coin race 12 may be attached to a side wall of a vending machine by attachment plates 20 and 22. The coin race 12 preferably extends downwardly from the coin entrance 24 at an angle sufficient to allow coins to traverse the coin race 12 through the force of gravity. More preferably, coin race 12 extends downwardly from coin entrance 24 at an angle of between about −30° and about −60°; even more preferably, at an angle of about −45°.

Figure 3:
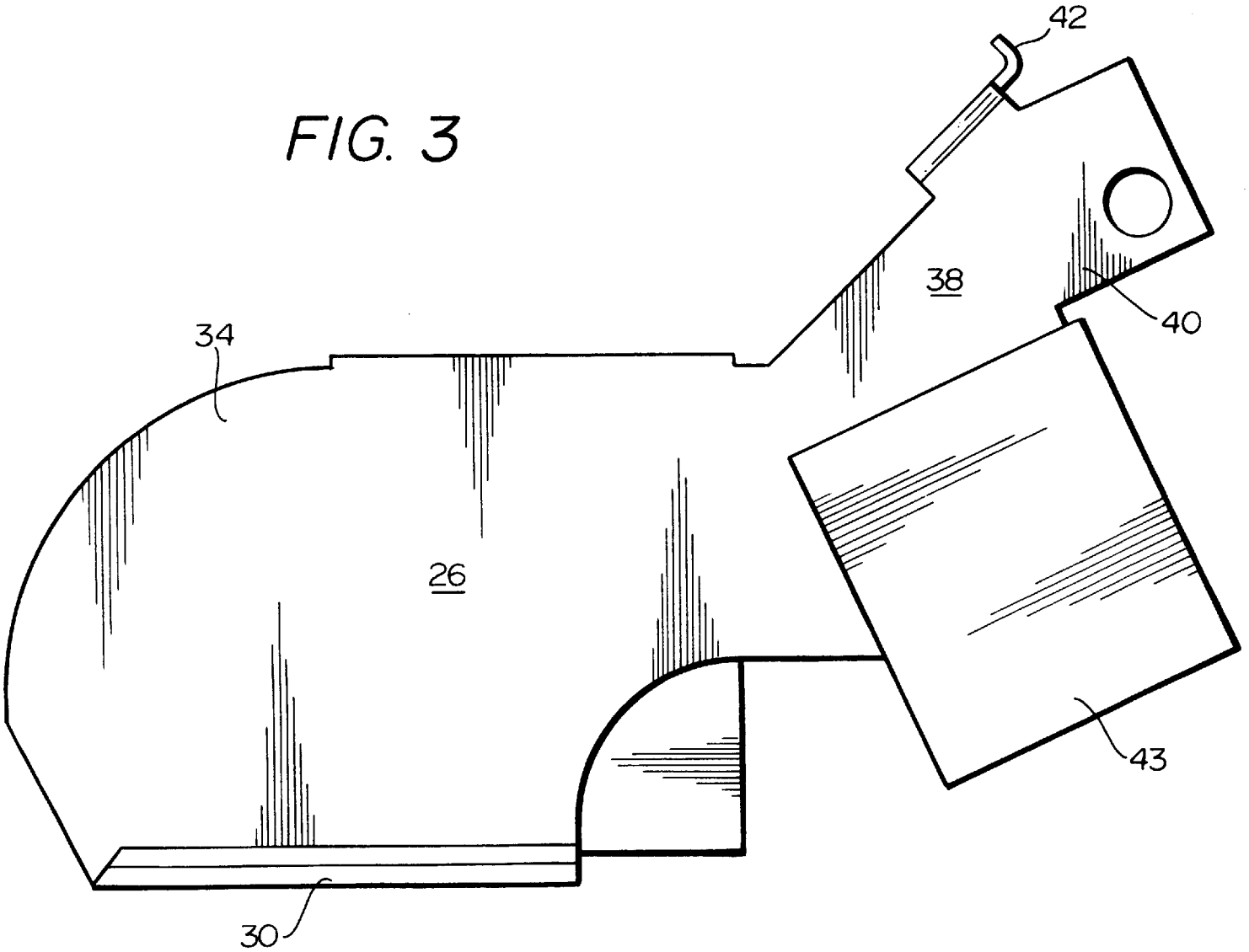
FIG. 3 is a front left perspective view of an ejection member of the anti-corruption coin/token chute assembly of the present invention.

To facilitate ejection of unwanted objects from coin race 12, an ejection member 26, depicted in detail in FIG. 3, is movably, preferably pivotably, coupled to the second side wall 16 of coin race 12. In the illustrated embodiment, ejection member 26 is coupled to coin race 12 by a screw 28 which allows the ejection member 26 to be rotated with respect to the coin race 12.

Ejection member 26 includes a coin race insert 30 having first and second side walls 32 and 34 that define lateral boundaries. Similar to coin race 12, coin race insert 30 also includes a floor 36 that interconnects the first and second side walls 32, 34 such that the first and second side walls 32, 34 are separated by a distance defined by a width of the floor 36. Preferably the separation distance defined by the floor of coin race 12 is slightly greater than the separation distance defined by the floor of coin race insert 30 to facilitate nesting of the coin race insert 30 in the coin race 12.

Ejection member 26 may also include a displacement arm 38 for inducing rotation of coin race insert 30. Preferably, displacement arm 38 includes a stem portion 40 integrally formed with the second side wall 34 of ejection member 26 and a lever 42 extending from the stem portion 40. When biased in the rest position, coin race insert 30 is preferably nested within coin race 12 such that the floor 36 of coin race insert 30 is substantially parallel and substantially contiguous to the floor of coin race 12.

In addition, ejection member 26 is preferably provided with a retaining wall 43. When ejection member 26 is biased in the rest position, retaining wall 43 may be positioned at the bottom of coin race 12 to deflect stray coins into the coin acceptance assembly.

In a typical vending machine, stem portion 40 is operatively (mechanically, electrically or electro-mechanically) connected with an ejection actuation mechanism. For example, in FIG. 6, a button coin return mechanism 50 is provided in operative relationship with a coin return arm 52. Stem portion 40 is coupled to the coin return arm via a link are connector 54. Due to the nesting arrangement of coin race insert 30 and coin race 12, ejection member 26 functions to clear slugs and other unauthorized objects from coin race 12 as well as to clear and return authorized coins/tokens that may have become lodged in coin race 12.

In operation, ejection of unwanted objects from coin race 12 may be achieved by activating the coin return mechanism 50. When coin return mechanism 50 is activated coin return arm 52 is displaced thus causing link arm 54 to exert a force on stem portion 40 that causes coin race insert 30 to rotate. Preferably, coin race insert 30 may be rotated to any desired position within an arc of about 180° from floor 18 of coin race 12. This causes ejection member 26 to pivot and lift the unwanted objects out of coin race 12 and deposit them into a coin bin or acceptance assembly (not shown). In its simplest form, the entire content of the coin race is ejected into an underlying coin bin. In a more sophisticated form, the content may be discharged into a companion coin acceptance assembly to discriminate reusable coins from slugs and other unauthorized objects. The reusable coins may be returned to the user while the unwanted objects such as slugs, paper clips and the like may be directed to a separate receptacle for discard.

Figure 4:
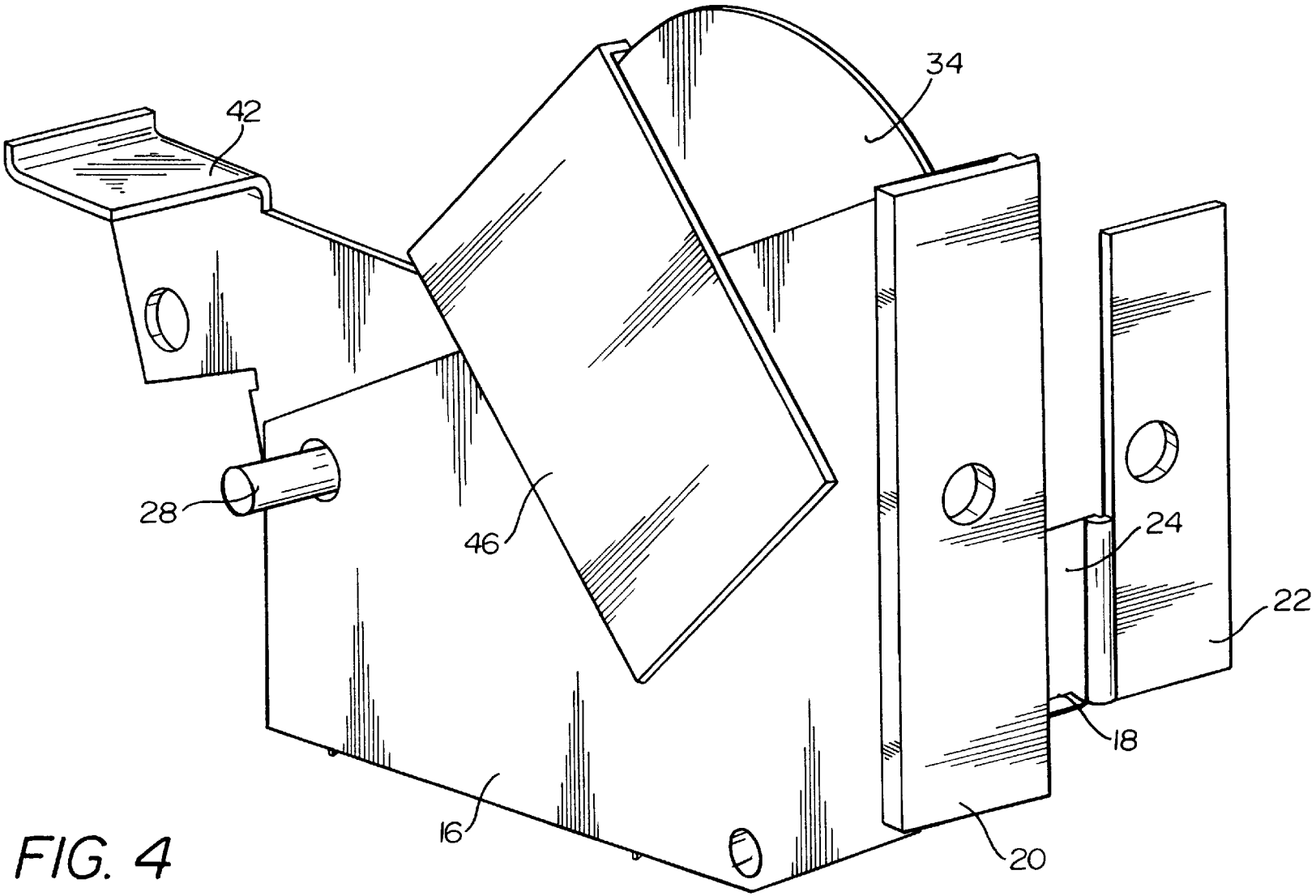
FIG. 4 is a front left perspective view of the anti-corruption coin/token chute assembly of the present invention.
Figure 5:
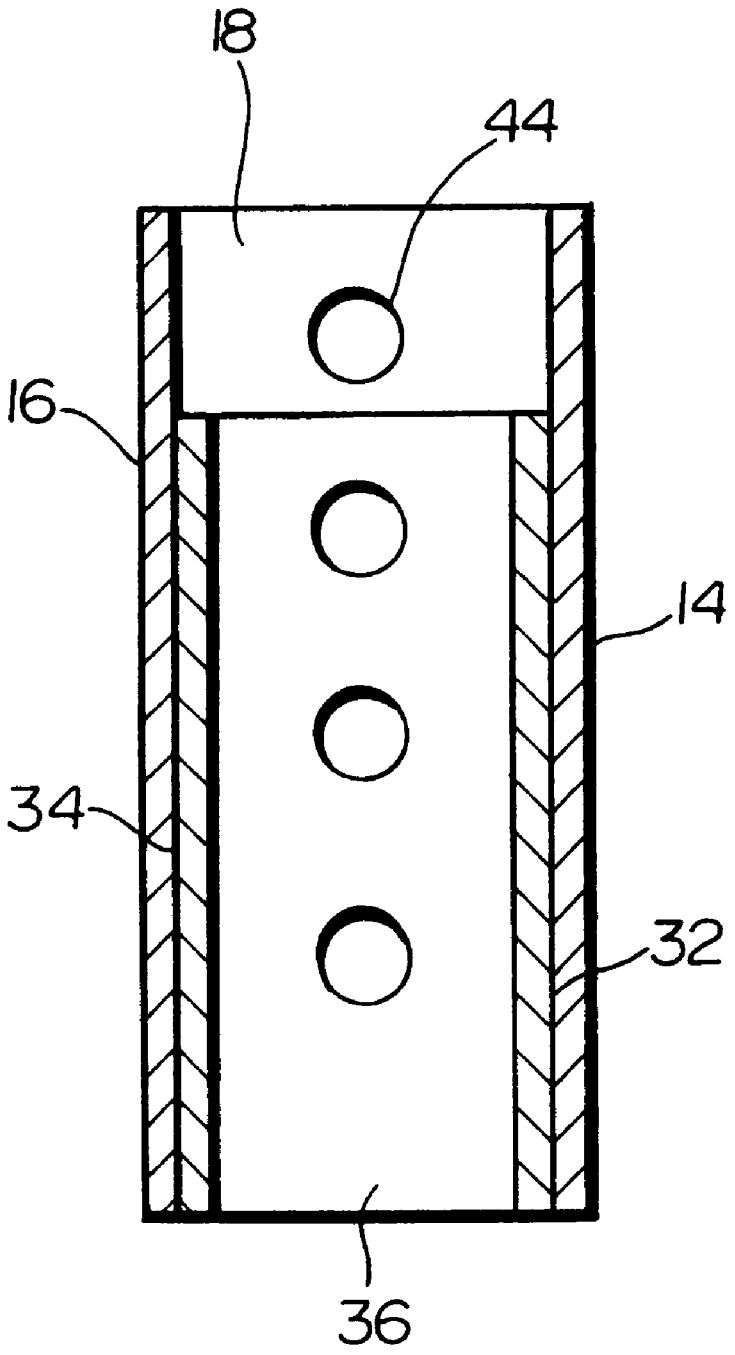
FIG. 5 is a top view showing the coin race insert of the ejection member nested in the coin race.

To assist in returning coin race insert 30 to the rest position after objects are ejected, a guide member 46 is provided as shown in FIG. 4. As coin race insert 30 is returned to the rest position, guide member 46 engages the second side wall 34 to guide coin race insert 30 into a nesting position with coin race 12. In a preferred embodiment, guide member 46 includes a band 48 that, together with the second side wall 34 of coin race insert 30, forms a U-shaped structure. Guide member 46 preferably has a width slightly greater than the thickness of the second side wall 34 to facilitate engagement.

In accordance with an aspect of the invention, to protect sensitive electronic components that are often found in known coin acceptance assemblies, floor 18 of the coin race 12 and floor 36 of the coin race insert 30 are each provided with a plurality of apertures 44 as depicted in FIG. 4. Apertures 44 serve to prevent salting by draining liquid that may find its way into coin entrance 24 before the liquid reaches the electronic components of the coin acceptance assembly. Because the respective floors 18, 36 of the coin race 12 and the coin race insert 30 are nested when the ejection member 26 is in the rest position, apertures 44 of coin race 12 are preferably substantially aligned with the apertures 44 of coin race insert 30 to achieve maximum drainage. Apertures 44 are preferably positioned in floors 18 and 36 so as not to significantly impede the rolling or sliding of coinage along coin race 12. More preferably, the surface area defined by each aperture 44 is several orders of magnitude smaller than the surface area of any of the coins intended for use with the anti-corruption coin/token input chute 10.

Many modifications and variations may be made in the techniques and structures described and illustrated herein without departing form the spirit and scope of the present invention. Accordingly, it should be readily understood that the embodiments described and illustrated herein are illustrative only, and are not to be considered as limitations upon the scope of the present invention.

What is claimed is:

1. An anti-corruption coin/token input chute assembly comprising:

a coin race including first and second side walls and a floor, the floor including a plurality of apertures that facilitate release of foreign substances from said coin race; and an ejection member movably coupled to the first side wall, said ejection member including:

a coin race insert appropriately sized to fit between said first and second side walls of said coin race, the race insert including first and second side walls and a base, the base including a plurality of apertures, a displacement arm extending from the second side wall of said ejection member adapted to move said ejection member from a first position where the floor of said coin race and the floor of the coin race insert are substantially parallel and the apertures of the floor of said coin race are substantially aligned with the apertures of the floor of the coin race insert to a second position where the floor of the coin race insert is displaced relative to the floor of said coin race to eject objects from said coin race.

2. The anti-corruption coin/token input chute assembly of claim 1 wherein said ejection member is pivotally coupled to the first side wall of said coin race.

3. The anti-corruption coin/token input chute assembly of claim 2 wherein the second position of said ejection member includes a position wherein the coin race insert is angularly displaced relative the floor of said coin race by an angle of up to about 180°.

4. The anti-corruption coin/token input chute assembly of claim 2 wherein the first position of said ejection member includes a position wherein the coin race insert is nested within said coin race.

5. The anti-corruption coin/token input chute assembly of claim of claim 4 wherein the coin race insert is contiguous to said coin race in the first position.

6. The anti-corruption coin/token input chute assembly of claim 1 further comprising first and second attachment plates coupled to the first and second side walls of said coin race, respectively, wherein the first and second side walls of said coin race and the first and second attachment plates define a coin entrance.

7. The anti-corruption coin/token input chute assembly of claim 6 wherein the floor of said coin race extends downwardly from the coin entrance.

8. The anti-corruption coin/token input chute assembly of claim 7 wherein the floor of said coin race extends downwardly from the coin entrance at an angle of about −30° to an angle of about −60°.

9. The anti-corruption coin/token input chute assembly of claim 8 wherein the floor of said coin race extends downwardly from the coin entrance at an angle of about −45°.

10. The anti-corruption coin/token input chute assembly of claim 1 wherein said ejection member includes a guide member engaged with the second side wall of said coin race when said ejection member is in the first position.

11. The anti-corruption coin/token input chute assembly of claim 10 wherein the guide member includes a band attached to the second side wall of said ejection member in such a manner as to form a U-shaped clip.

12. The anti-corruption coin/token input chute assembly of claim of claim 11 wherein the U-shaped clip includes a width slightly greater than a width of the second side wall of said coin race to facilitate engagement of the U-shaped clip and the second side wall of said coin race.

13. The anti-corruption coin/token input chute of claim 1 wherein said displacement arm is operatively connected with an ejection actuation mechanism.

14. An anti-corruption coin/token input chute assembly comprising:

a coin race including first and second side walls and a floor, the floor including means for draining liquid from said coin race; and means for ejecting objects from said coin race, said means for ejecting being disposed within and being movably coupled with said coin race and said means for ejecting further including means for draining liquid in substantial alignment with the means for draining liquid of said coin race;

wherein said means for draining liquid from said coin race includes a plurality of apertures disposed in the floor of said coin race; and wherein said means for ejecting objects from said coin race includes a coin race insert having first and second side walls and a floor.

15. The anti-corruption coin/token input chute assembly of claim 14 wherein said means for draining liquid of said means for ejecting objects includes a plurality of apertures disposed in the floor of the coin race insert.

16. The anti-corruption coin/token input chute assembly of claim 14 wherein said means for ejecting moves the coin race insert between a first position and a second position.

17. The anti-corruption coin/token input chute assembly of claim 16 wherein the coin race insert is nested within said coin race in the first position.

18. The anti-corruption coin/token input chute assembly of claim 16 wherein said means for ejecting rotates the coin race insert through an angle of up to 180°.

19. The anti-corruption coin/token input chute assembly of claim 16 further comprising means for guiding said coin race insert from the second position to the first position.

* * * * *